US006337674B1

(12) United States Patent
Kim

(10) Patent No.: US 6,337,674 B1
(45) Date of Patent: Jan. 8, 2002

(54) DRIVING METHOD FOR AN ALTERNATING-CURRENT PLASMA DISPLAY PANEL DEVICE

(75) Inventor: Kyu-Tae Kim, Kyungki-Do (KR)

(73) Assignee: Hyundai Electronics Industries Co., Ltd., Ichon-shi (KR)

( * ) Notice: Subject to any disclaimer, the term of this patent is extended or adjusted under 35 U.S.C. 154(b) by 0 days.

(21) Appl. No.: 09/229,969

(22) Filed: Jan. 14, 1999

(30) Foreign Application Priority Data

Mar. 13, 1998 (KR) ..... 98/8506

(51) Int. Cl.[7] ..... G09G 3/28; G09G 3/288
(52) U.S. Cl. ..... 345/66; 345/60; 315/169.4
(58) Field of Search ..... 345/60, 66

(56) References Cited

U.S. PATENT DOCUMENTS

| | | | | |
|---|---|---|---|---|
| 5,420,602 A | | 5/1995 | Kanazawa | 345/67 |
| 5,436,634 A | | 7/1995 | Kanazawa | 345/67 |
| 5,475,448 A | * | 12/1995 | Saegusa | 348/797 |
| 5,541,618 A | * | 7/1996 | Shinoda | 345/60 |
| 6,160,529 A | * | 12/2000 | Asao et al. | 345/60 |
| 6,278,420 B1 | * | 8/2001 | Mikoshiba et al. | 345/60 |

FOREIGN PATENT DOCUMENTS

JP 10-11020 * 1/1998 ..... G09G/3/28

* cited by examiner

*Primary Examiner*—Steven Saras
*Assistant Examiner*—William C. Spencer
(74) *Attorney, Agent, or Firm*—Fleshner & Kim, LLP

(57) ABSTRACT

An alternating-current plasma display panel (AC PDP) and a method for driving same are provided that reduce or remove flickering and increase luminance. The AC PDP can include first electrodes connected to one another, second electrodes for display lines that are in parallel with the first electrodes, and addressing electrodes provided orthogonal to the first and second electrodes. The first and second electrodes perform a wall charge accumulation function and form display lines. The method for driving the AC PDP can include writing a sub-frame to the plasma display panel device (PDP) in an addressing period for maintenance discharge to an odd(even) sub-frame and simultaneously performing the maintenance discharge on the even(odd) sub-frame. Then, carrying out the maintenance discharge on the odd(even) sub-frame, and at the same time writing the sub-frame to the plasma display panel device in the addressing period for the next succeeding maintenance discharge to the even(odd) sub-frame. Thus, a frame displaying an image is preferably divided into odd sub-frames and even sub-frames, and the maintenance discharge is carried out on each other in the respective addressing periods to remove flicker and improve a screen luminance.

18 Claims, 8 Drawing Sheets

FIG. 3A
BACKGROUND ART
FIG. 3B
BACKGROUND ART
FIG. 3C
BACKGROUND ART
FIG. 3D
BACKGROUND ART
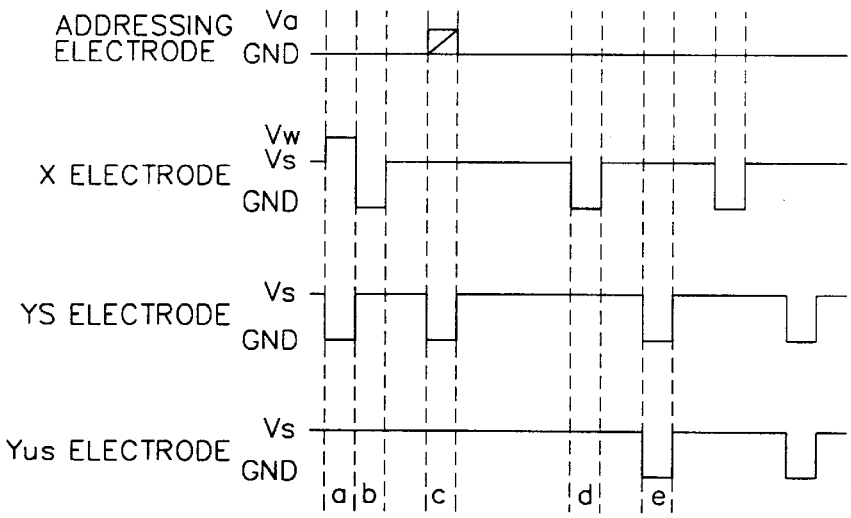
FIG. 4A
BACKGROUND ART
FIG. 4B
BACKGROUND ART
FIG. 4C
BACKGROUND ART
FIG. 4D
BACKGROUND ART
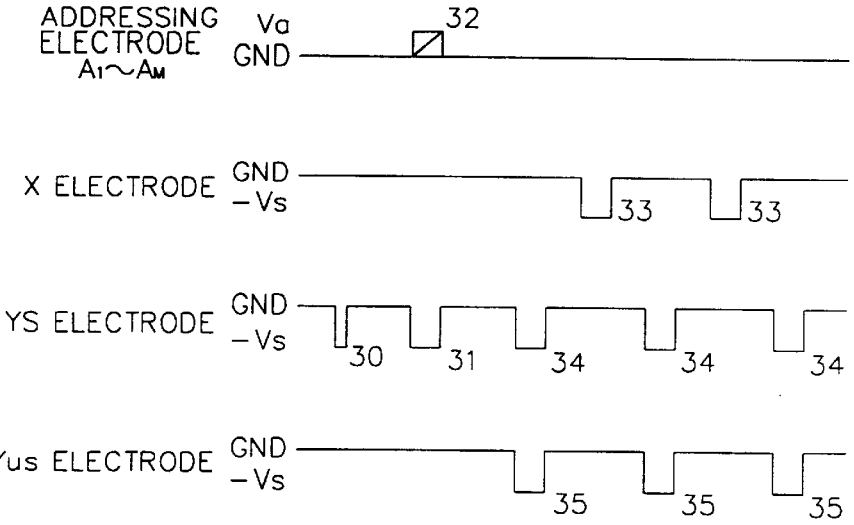

DRIVING METHOD FOR AN ALTERNATING-CURRENT PLASMA DISPLAY PANEL DEVICE

BACKGROUND OF THE INVENTION

1. Field of the Invention

The present invention is directed to a display panel device, and in particular, to a method for driving a display device such as an alternating-current plasma display panel (AC PDP) device.

2. Background of the Related Art

A flat display device has small size and capacity, and requires a small amount of electric power. A plasma display panel (PDP) device can be used in a television of a considerable size.

The principle that light is emitted from glow discharge generated during the recombination of ionized gas is adopted to the plasma display panel device. FIG. 1 illustrates a related art three-electrode plasma display panel device for implementing the above-described principle. FIG. 1 illustrates a cross-sectional view of a pixel. Millions of pixels are formed and used in a display operation of a PDP device.

The alternating-current plasma display panel device includes first and second glass substrates 1, 2 that are configured in parallel with each other with a space between for plasma to be generated and discharged. Addressing electrodes 4 are deposited on the first glass substrate 1, and a plurality of X electrodes 6 and a plurality of Y electrodes 7, which are alternately deposited in parallel with each other, are formed on the second glass substrate 2. A MgO thin film 5 that is generally used as a dielectric layer is coated over the respective electrodes 4, 6, 7. The MgO thin film 5 serves to cause a second electron generation during bombardment, protect the electrodes and provide the pixels with a memory function. The plasma is generated by applying a proper voltage to the electrodes. The light that is emitted from the plasma is utilized for the display operation. That is, the light stimulates a phosphor, which is provided in close proximity to the electrodes, to display color images.

Related art methods of driving plasma display panels will now be described. FIG. 2 illustrates an organic connection of a panel 8 having a matrix including multiple plasma display cells, an X electrode driving device 9 coupled to the X electrodes in the panel 8, a Y electrode driving device or a scan driving device 10 coupled to the Y electrodes in the panel 8, and an addressing electrode driving device 11 coupled to the addressing electrodes. The X and Y electrodes are also referred to as sustain electrodes.

FIG. 3*a* to 3*d* are waveform diagrams according to a first related art driving method for displaying images on the panel. A pulse is applied to the X electrodes and an Ys electrode that is a selected display line as shown in "a" and "b" time periods of FIGS. 3*b* and 3*c*. Yus electrodes that are not selected are set to a level of Vs as shown in FIG. 3*d*. Wall charges including positive or negative charges are generated over the sustain electrodes. A data writing operation is performed on the addressing electrodes in "c" time period as shown in FIG. 3*a*. Thus, a discharge resulting from plasma generation is performed on the cells, and light is emitted therefrom. To maintain such a condition or have a so-called memory function, it is necessary to alternately apply an oppositely-polarized voltage to the X and Y electrodes as illustrated in "d" and "e" time periods. The oppositely polarized voltage maintains a discharge maintenance condition and enables the displayed cell to constantly emit light.

Cells where the plasma is not generated are in a dischargeable condition, but light is not emitted therefrom.

FIGS. 4*a* to 4*d* are waveform diagrams of a second related art method of driving the plasma display panel device. In this method, a negative voltage (−Vs) and a ground potential GND are applied to the X and Y electrodes. A narrow erase pulse is used for the Y electrodes like a pulse 30 as shown in FIG. 4*c* to complete a write operation and leave the wall charges. Thus, the second related art method operates differently from the method illustrated in FIGS. 3*a* to 3*d*. When the Y electrodes Yus that are not selected maintain a potential level of GND, a voltage pulse 31 of −Vs is applied to the selected Y electrodes with the address data pulse 32 to excite the cells. In order to maintain this condition, pulses 33, 34 are repeatedly applied to the respective X and Y electrodes. A maintenance pulse 35 is also used for the unselected Y electrodes Yus to prepare for selection.

However, the first and second related art methods have a disadvantage in that a display does not have a plurality of intensity levels. This disadvantage can be overcome in accordance with a third related art method illustrated in FIGS. 5*a* to 5*f*.

In the third related art driving method, a frame is divided and driven in a total write period I, a data write period II as an addressing period, and a maintenance discharge period III. In the total write period I, $Y_1$ to $Y_{100}$ electrodes are set to the potential level of GND, and a write pulse 24 of Vw that is sufficiently large to cause a discharge is applied to the X electrodes. Then, a voltage of Vs is applied to the $Y_1$ to $Y_{100}$ electrodes to have the potential level of Vs, and a pulse 25 is applied to the X electrodes to be in a discharge maintenance condition. Accordingly, the X and Y electrodes enter the addressing period II having the wall charges.

In the addressing period II, the data 27, which will be displayed, is applied to the addressing electrodes as shown in FIG. 5*a*, and the selected Y electrode is correspondingly set to the potential level of GND as shown in FIG. 5*c*. Thereby, the wall charges of a selected cell are erased, and a cell that will be displayed is selected. In this case, an image of a frame is displayed by the discharge maintenance period III, and the intensity levels are determined by the length of the discharge maintenance period III.

FIG. 6 is a timing chart for displaying a plurality of intensity levels determined by the length of the discharge maintenance period. As shown in FIG. 6, a frame includes four sub-frames SF1, SF2, SF3, SF4. The discharge maintenance periods Td1, Td2, Td3, Td4 have a ratio of 1:2:4:8 and display 16 different intensity levels.

In the above-described related art methods, the plasma display panel device is not in a glowing condition, and thus the light intensity is reduced. U.S. Pat. No. 5,420,602 uses a fourth related art driving method as illustrated in FIGS. 7*a* to 7*f* to overcome such a disadvantage. This method is similar to the method illustrated in FIG. 5. However, in the fourth driving method, a write pulse is used more in the total write period, and a glowing amount is increased by lessening the length of the addressing period, differently from the method in FIG. 5. Moreover, the fourth related art method also has various disadvantages. In the fourth related art method flickering occurs in specific colors, and images that are relatively dark are provided because light is not emitted in the addressing period.

The above references are incorporated by reference herein where appropriate for appropriate teachings of additional or alternative details, features and/or technical background.

SUMMARY OF THE INVENTION

An object of the present invention is to provide a method of operating a display device that substantially obviates at least one of the problems caused by disadvantages or limitations of the related art.

Another object of the present invention to provide an alternating-current plasma display panel device that prevents a flickering from occurring in specific colors.

Another object of the present invention is to provide a method for driving a plasma display that divides a frame displaying an image into odd sub-frames and even sub-frames to carry out maintenance discharge on each other in respective addressing periods.

Another object of the present invention is to provide a method of operating a display panel that subdivides the Y-electrode so that concurrent addressing and maintenance discharge occurs.

Another object of the present invention to provide a method of driving an alternating-current plasma display panel device to achieve the above-described objects.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein:

FIGS. 3*a* to 3*d* are diagrams that shows timing waveforms for driving the alternating-current plasma display panel device in accordance with a related art method;

FIGS. 4*a* to 4*d* are diagrams that shows timing waveforms for driving the alternating-current plasma display panel device in accordance with another related art method;

DETAILED DESCRIPTION OF PREFERRED EMBODIMENTS

In accordance with preferred embodiments of the present invention, when a frame is displayed as an image, it is preferably divided into an image of a first group and an image of a second group, and displayed. However, the preferred embodiments are not intended to be so limited. Alternative divisions of the frame may be used. The two images of the first and second groups are preferably displayed by dividing a frame into first and second sub-frames. The respective sub-frames are used, for example, with odd and even display lines and are compatible with related art interlaced scanning methods.

A flickering can occur in display devices such as described above with related art plasma display panel devices. However, the flickering disadvantage is overcome in accordance with the preferred embodiments of a method of driving a display device according to the present invention.

Figure 1:
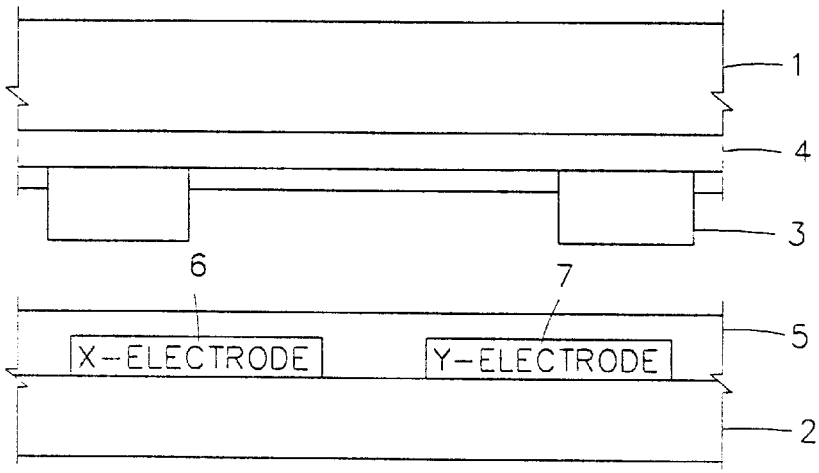
FIG. 1 BACKGROUND ART
FIG. 1 is a diagram that shows cross-sectional view of a pixel that forms a related art alternating-current plasma display panel device.

FIG. 1 is a diagram showing cross-sectional view of a general pixel cell. In the preferred embodiments, a three-electrode alternating-current plasma display panel device that includes the cell can be used. As illustrated in FIG. 1, X electrodes 6 and Y electrodes 7 are used for the display lines. In the preferred embodiments, the display lines are divided into odd display lines and even display lines to respectively correspond to a first sub-frame and a second sub-frame, and then serve to drive the first and second sub-frames. In the preferred embodiments the first sub-frame has an addressing period and the second sub-frame concurrently has a maintenance discharge period.

In addition, the first and second sub-frames are preferably each respectively divided into five sub-fields to display a plurality of intensity levels. The respective sub-fields include an addressing period and a maintenance discharge period, and further can include a suspension period, if necessary. The required intensity level is determined by a length ratio of the five sub-fields. The five sub-fields are used in the preferred embodiments of the present invention. However, the present invention is not intended to be so limited. For example, a different number of sub-fields can be used.

Figure 8:
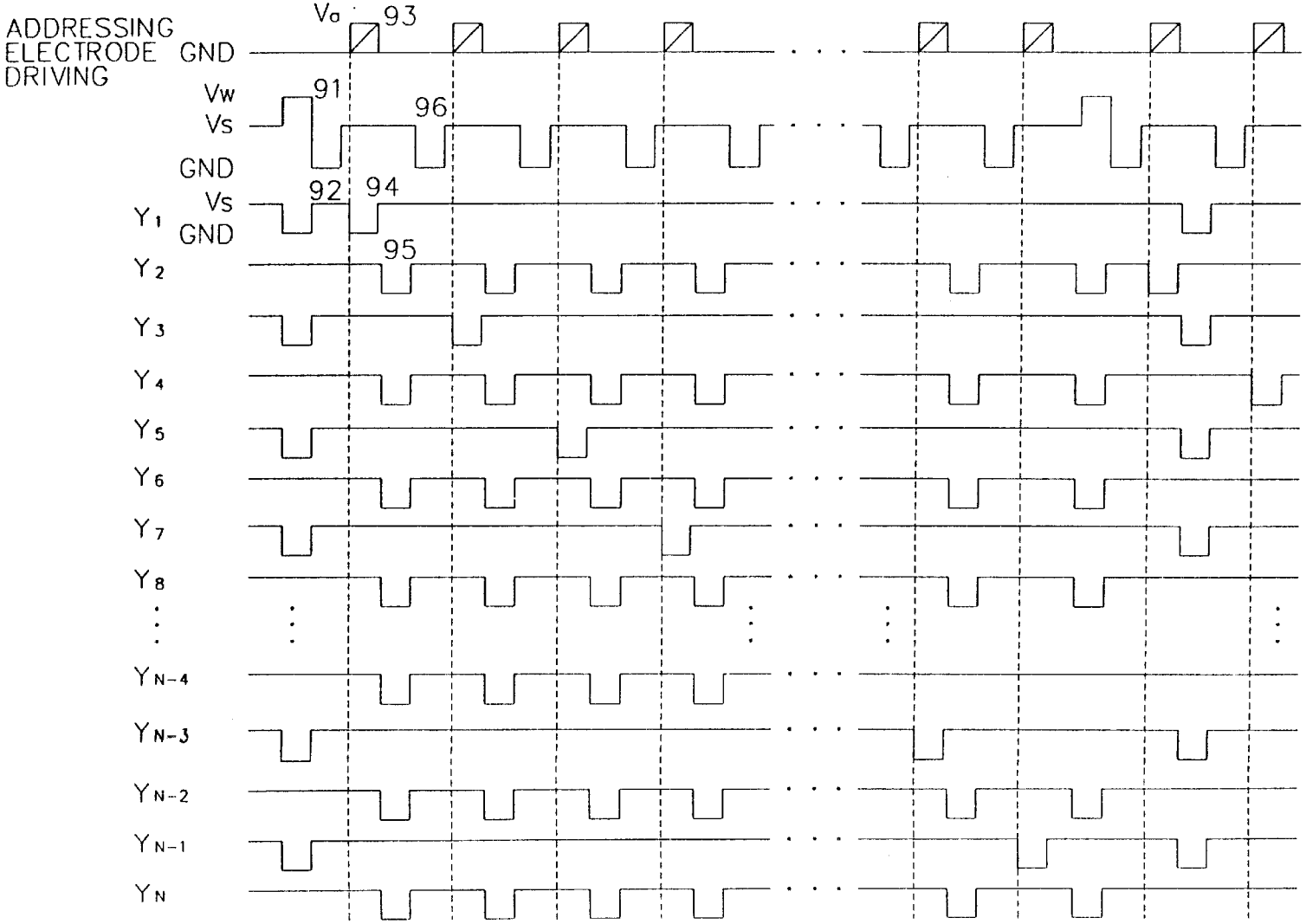
FIG. 8 is a diagram that shows timing waveforms of a preferred embodiment of a method for driving an alternating-current plasma display panel device in accordance with the present invention.

FIG. 8 is a waveform diagram showing a waveform of a first preferred embodiment of a method that drives a plasma display panel device of the present invention in an addressing period of a sub-frame and a maintenance discharge period of another sub-frame that corresponds to the sub-frame. As illustrated in FIG. 8, a total write period to the odd display lines is started by addressing driving the odd sub-frames. Waveform 91 having a voltage Vw is applied to the X electrodes, and a voltage potential of GND is applied to the odd display lines $Y_1, Y_3, \ldots Y_{N-1}$. Therefore, a potential difference, Vw-GND is generated between the X and selected $Y_{ODD}$ electrodes, and all the selected cells are in a discharge condition. Then, a voltage potential of GND preferably as waveform 92 is applied to the X electrodes, while a potential of Vs is applied to the selected odd Y electrodes. Accordingly, the selected odd Y electrodes can maintain discharging condition. In accordance with the first preferred embodiment, while an addressing operation is carried out on the odd display lines, a maintenance discharge operation is performed on the even display lines. As shown in FIG. 8, the voltage potentials of the even display lines, namely, the potentials of the Y electrodes ($Y_2$, $Y_4$, . . . $Y_N$) and the X electrodes are respectively set to be GND and Vs.

As the cells of the selected odd display lines are all selected, the cells over a first odd display line (i.e., the first Y electrode $Y_1$) that was not selected must be turned off. Therefore, a voltage of Va such as waveform 93 and a waveform signal 94 of GND level are respectively applied to the addressing electrode and the first odd Y electrode $Y_1$. Thus, the erase operation or the write operation is performed for a data to be displayed. As a result, the wall charges accumulated in the X electrodes are erased.

When the data write operation to the first odd display lines is completed, the even display lines are set to a voltage potential level of GND using waveform 95 or the like, which provides the X and Y electrodes with a maintenance discharge effect.

Waveform 96 is applied to the X electrodes, and thereby the odd and even display lines have a period for maintaining the discharge. A waveform is applied to a corresponding Y electrode in order to have a GND potential for the discharge maintenance period.

As shown in FIG. 8, during the addressing period to the odd Y electrodes, the addressing operation to the first Y electrode $Y_1$ and the maintenance discharge operation to the even Y electrodes are carried out. Then, the addressing operation to a third Y electrode and the maintenance discharge operation to the even Y electrodes are preferably continuously performed in a similar manner. When the above-described process is carried out on the odd display line $Y_{N-1}$, video information regarding the odd display lines is written while the maintenance discharge operation to the even display lines is continued.

In general, an intensity level is determined by a number of maintenance discharge operations. Accordingly, a number of the above-described maintenance discharge operations to the even display lines is determined by its intensity level.

Figure 9:
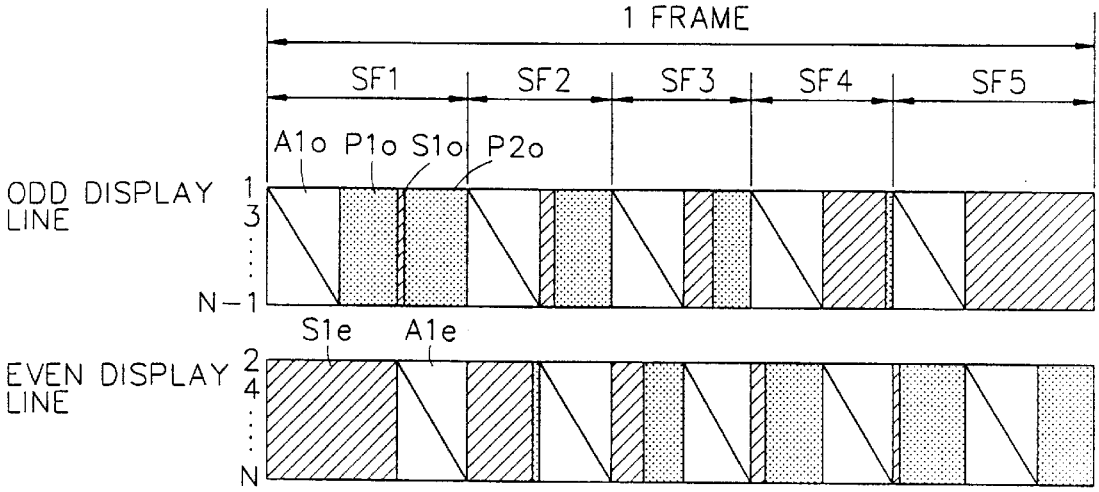
FIG. 9 is a diagram that shows a timing chart of the alternating-current plasma display panel device in accordance with another preferred embodiment of a driving method of the present invention.

FIG. 9 is a diagram showing a timing chart for a second preferred embodiment of a method for driving the plasma display panel device in accordance with the present invention. As shown in FIG. 9, a frame is divided into five sub-fields SF1–SF5. The respective sub-fields each have an addressing period, and thus the frame has five addressing periods. While an addressing period A1o to the odd display lines is preferably performed first in a first sub-field SF1, a predetermined number of maintenance discharge operations that correspond to their intensity levels are carried out on the even display lines Sle.

According to the second preferred embodiment of the present invention, a discharge length ratio for the plasma display panel device is 1:2:4:8:16. That is, when the length of a first sub-field SF1 designates a number of levels required, the length of remaining sub-fields is controlled by a number of levels determined by the above-mentioned ratio and the number of the longest first sub-field.

Accordingly, the length of discharge is variable and the addressing period is fixed. Thus, an odd sub-frame period can be different from an even sub-frame period. To solve this problem as illustrated in FIG. 9, a suspension period P1o is inserted after the addressing period A1o of the odd display line in the first sub-field SF1. The maintenance discharge period S1o follows the suspension period.

The respective sub-fields SF1–SF5 preferably correspond to one another in the addressing period to the odd(even) lines, and thus the odd(even) lines have a maintenance discharge period. That is, a frame is divided into the odd and even display lines and displayed on the plasma display panel device. Consequently, an increased intensity of in a plasma display panel device is provided because a line is discharged in the addressing period to another line. In addition, a flickering is prevented.

Figure 2:
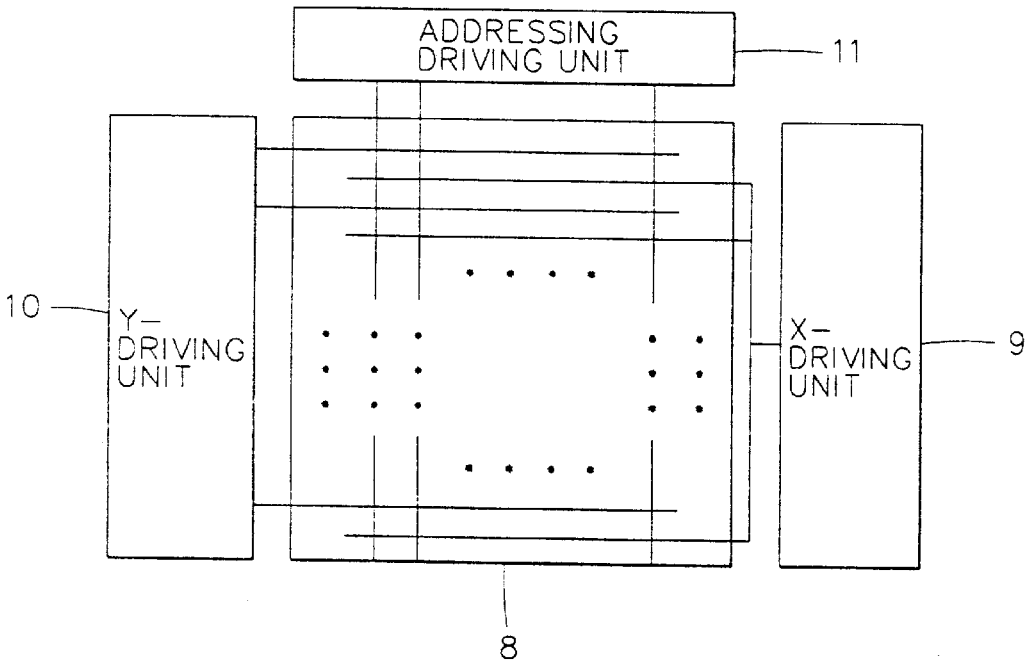
FIG. 2 BACKGROUND ART
FIG. 2 is a block diagram that shows peripheral circuits that drive the alternating-current plasma display panel device of FIG. 1.
Figures 5A, 5B, 5C, 5D, 5E, 5F:
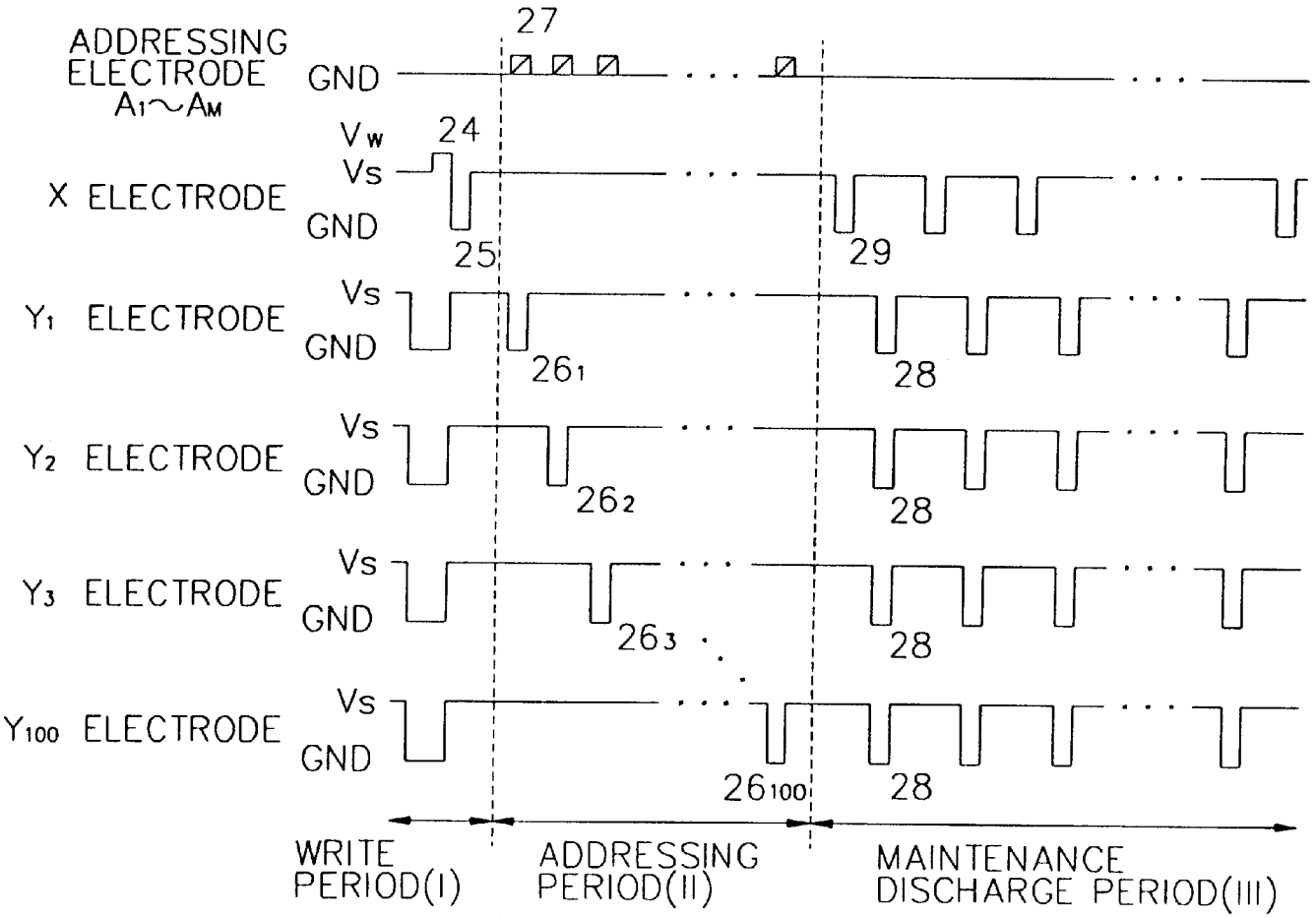
FIG. 5A BACKGROUND ART
FIG. 5B BACKGROUND ART
FIG. 5C BACKGROUND ART
FIG. 5D BACKGROUND ART
FIG. 5E BACKGROUND ART
FIG. 5F BACKGROUND ART
FIGS. 5*a* to 5*f* are diagrams that shows timing waveforms for driving the alternating-current plasma display panel device in accordance with another related art method.
Figure 6:
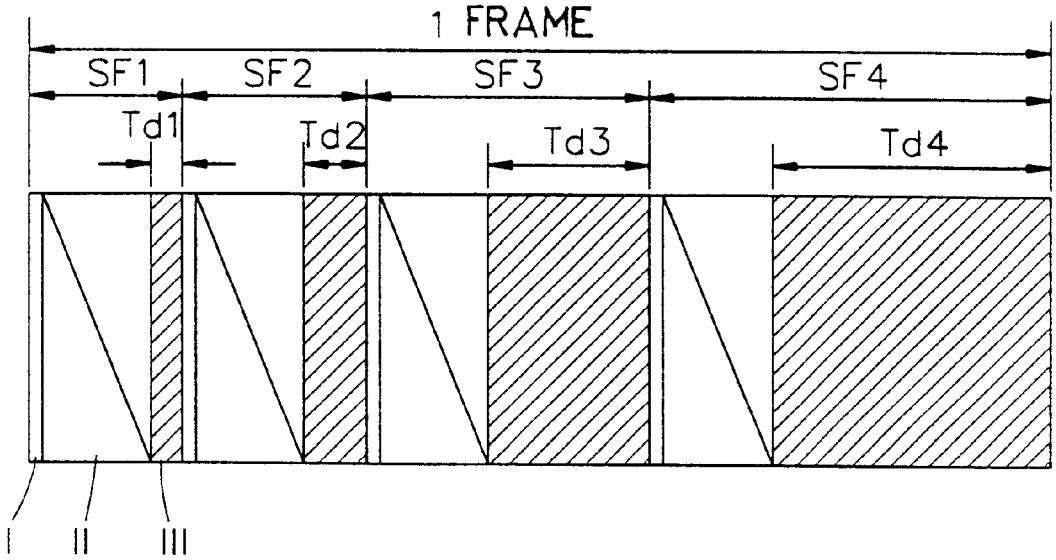
FIG. 6 BACKGROUND ART
FIG. 6 is a diagram that shows a timing chart for displaying a plurality of intensity levels of an alternating-current plasma display panel device.
Figures 7A, 7B, 7C, 7D, 7E, 7F:
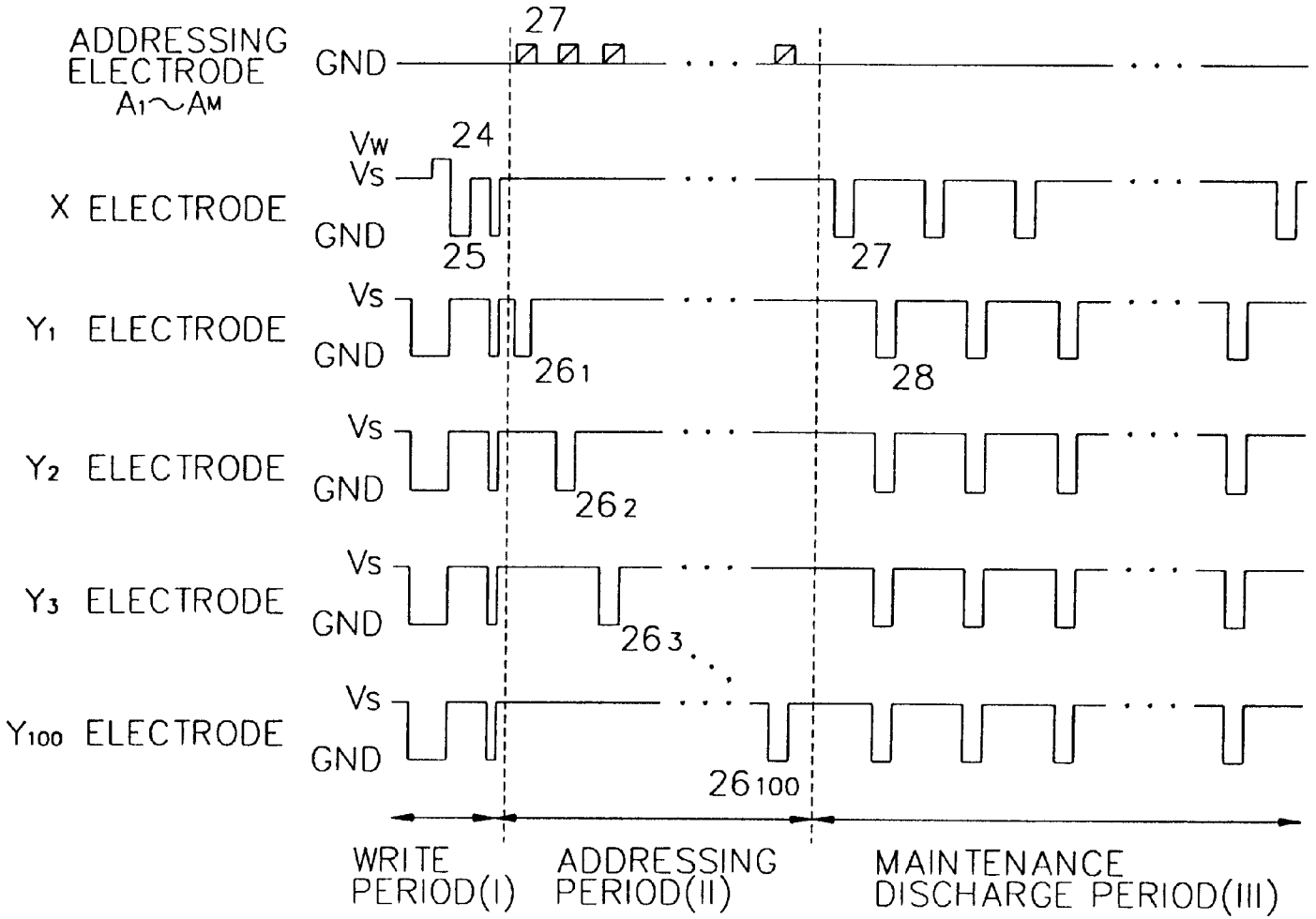
FIG. 7A BACKGROUND ART
FIG. 7B BACKGROUND ART
FIG. 7C BACKGROUND ART
FIG. 7D BACKGROUND ART
FIG. 7E BACKGROUND ART
FIG. 7F BACKGROUND ART
FIGS. 7*a* to 7*f* are diagrams that shows timing waveforms for driving the alternating-current plasma display panel device in accordance with another related art method.

To generate the waveforms illustrated in FIG. 9 for the above-described operations of the first preferred embodiment, a driving device such as the related art driving device shown in FIG. 2 can be used. However, it may be necessary to partially correct a display data controller serving to generate waveforms for driving the addressing electrodes, X electrodes and Y electrodes. However, pursuant to the waveforms illustrated in FIG. 8, the controller can be corrected to output the waveforms shown in FIGS. 3 to 5 and 7. Therefore, one of ordinary skill in the art could perform such a correction.

Figure 10:
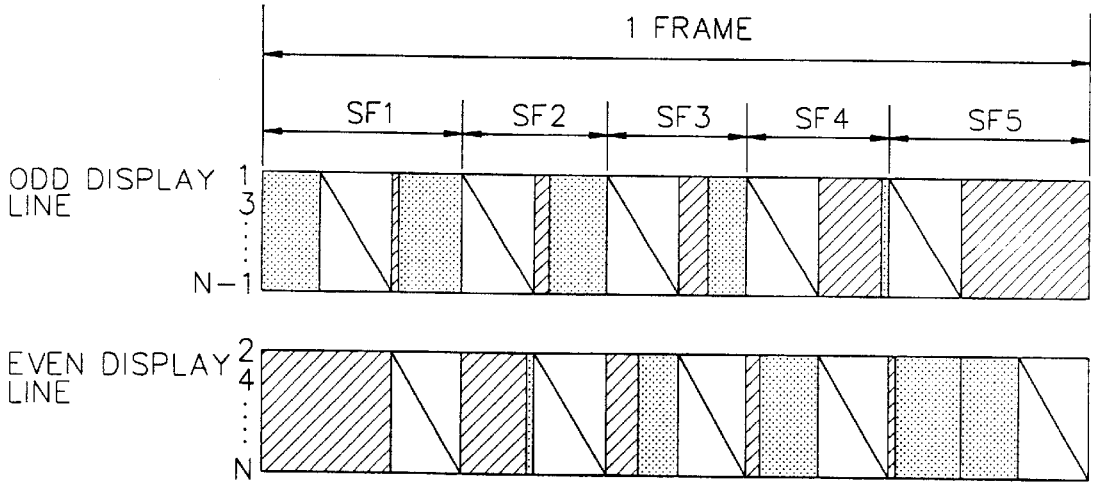
FIG. 10 is a diagram that shows a timing chart of the alternating-current plasma display panel device in accordance with another preferred embodiment of a drawing method of the present invention.

FIG. 10 is a diagram that illustrates a third preferred embodiment of a driving method according to the present invention. The driving method in FIG. 10 is similar to that of the second preferred embodiment in FIG. 9. However, an order of the suspension period and the addressing period is preferably different in the first and fifth sub-fields SF1, SF5. Although the order is different according to the third preferred embodiment, the addressing period of a first sub-frame must correspond to the maintenance discharge of a different display line of a second sub-frame corresponding to the addressing period. As shown in FIG. 10, the third preferred embodiment reverses the order of the suspension and addressing periods.

Figure 11:
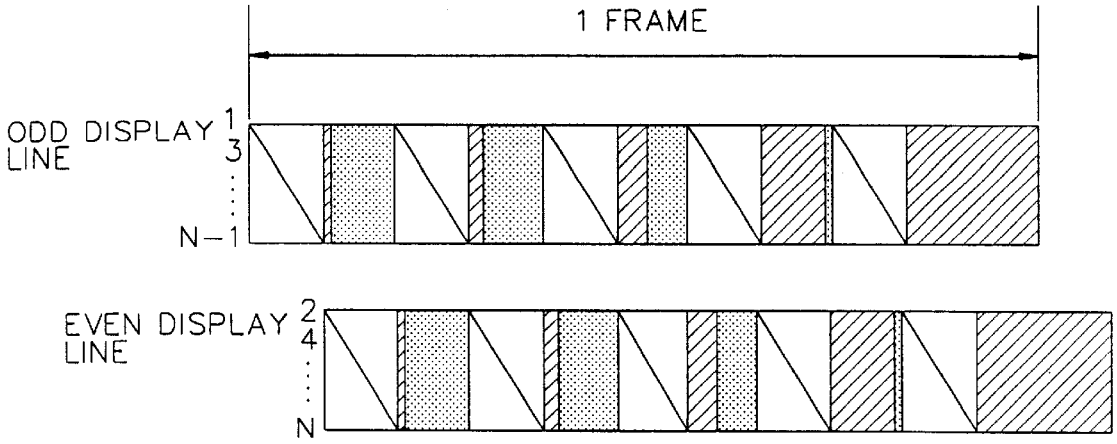
FIG. 11 is a diagram that shows a timing chart of the alternating-current plasma display panel device in accordance with another preferred embodiment of a driving method of the present invention.

FIG. 11 is a diagram that shows a fourth preferred embodiment of a driving method according to the present invention. In the embodiments illustrated in FIGS. 9 and 10, the maintenance discharge length of the odd display line is opposite to that of the even display line that corresponds to the odd display line. That is, a longest portion and a shortest portion of the selected intensity level are displayed together in a sub-field.

However, in FIG. 11, the longest maintenance discharge period is preferably equally applied to the odd and even display lines. Thus, the fourth preferred embodiment has an advantage in that the identical information is displayed in an identical period, and thus a frame can be displayed in a shorter period.

The odd display line is displayed before the even display line during the television scanning of an interlaced scanning method. As the driving method shown in FIG. 11 has a small time difference, the odd display line is displayed before the even display line. However, the difference between the two driving methods is that a scanning is performed once in a television but several times in the plasma display panel device. In the plasma display panel device driving method, a time difference cannot be recognized by viewers of the device, and thus, the driving method is effective.

Further, frame memories can be used in a plasma display panel device for driving the odd and even display lines at the same time in accordance with the preferred embodiments. The data that will be displayed is stored in the frame memories, divided into the odd and even display lines and displayed.

In addition, according to the preferred embodiments of the present invention, the addressing period and the maintenance discharge period correspond to each other in the driving of the odd and even display lines. Thus, one of the above-described related art cell driving methods can be used. For example, a driving method erasing wall charges by using a narrow erase pulse can be adopted to the preferred embodiments.

The foregoing embodiments are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A method of driving a display panel device having a matrix of pixels to display an image, the method comprising:

driving Y electrodes extending in a first direction with a first decoder;

driving X electrodes that extend parallel to the Y electrodes with a second decoder;

driving addressing electrodes that extend orthogonal to the X and Y electrodes with a third decoder, wherein each pixel includes an X electrode, a Y electrode and an addressing electrode;

dividing the image data into odd and even sub-frames of a data frame using first and second groups of the Y electrodes;

concurrently writing an image of the odd sub-frame using the first group of the Y electrodes in an addressing period for the first group of Y electrodes and performing maintenance discharge on an image of the even sub-frame using the second group of the Y electrodes in the first group of Y electrodes addressing period; and concurrently writing the image of the even sub-frame using the second group of Y electrodes in an addressing period for the second group of Y electrodes and performing the maintenance discharge on the image of the odd sub-frame using the first group of Y electrodes in the second group of Y electrodes addressing period, wherein each image writing period to each of said electrode groups is preceded by a single period in which the electrodes are prepared for the image writing by at least one of writing and erasing all members of the group at the same time.

2. The method of claim 1, further comprising storing the divided image data into framed memories.

3. The method of claim 1, further comprising forming the image from a plurality of sub-fields, wherein the writing step and the performing step form a sub-field, and wherein a plurality of intensity levels are provided using a prescribed ratio of maintenance discharge lengths in the sub-fields.

4. The method of claim 3, wherein the maintenance discharge lengths have predetermined order in the plurality of sub-fields, and wherein the first group maintenance discharge lengths have a reverse order relative to second group maintenance discharge lengths in the corresponding sub-fields of the image.

5. The method of claim 3, wherein first group maintenance discharge lengths and second group maintenance discharge lengths are in an identical order in the plurality of sub-fields in each of the sub-frames.

6. The method of claim 1, wherein the image of the first group forms odd display lines and the image of the second group forms even display lines.

7. A method of driving a display panel device having a plurality of pixel cells arranged in a matrix form of rows and columns to display an image, each of the cells having first electrodes extending in a first direction coupled with one another; second electrodes parallel to the first electrodes and addressing electrodes that are orthogonal to the first and second electrodes, the method comprising:

writing an image of the first group to the plasma display panel device in an addressing period for maintenance discharge to the image of the first group, and concurrently performing the maintenance discharge on an image of the second group in the addressing period; and performing the maintenance discharge on the image of the first group, and concurrently writing the image of the second group to the plasma display panel device in the addressing period for the next succeeding maintenance discharge to the image of the second group, wherein the writing an image is composed of a single writing or erasing phase to all electrodes of a group of the second electrodes followed by the writing the image line-by-line to the display panel device.

8. The method of claim 7, wherein the addressing electrodes are formed on a first substrate, wherein the first and second electrodes are formed on a second substrate separated from the first substrate by a prescribed distance, further comprising:

forming display lines in the image with the first and second electrodes; and accumulating wall charges using the first and second electrodes according to the image.

9. The method of claim 7, wherein the image of the first group forms an odd display line and the image of the second group forms an even display line.

10. The method of claim 7, further comprising forming the image from a plurality of sub-fields, wherein the writing step and the performing step form a sub-field, and wherein a plurality of intensity levels are provided using prescribed maintenance discharge lengths in the sub-fields.

11. The method of claim 10, wherein an image frame comprises five sub-fields having a prescribed ratio of maintenance discharge lengths to form 32 intensity levels, and wherein the addressing periods are a fixed length.

12. The method of claim 11, wherein the maintenance discharge lengths have predetermined order in the plurality of sub-fields, and wherein the first group maintenance discharge lengths have a reverse order relative to second group maintenance discharge lengths in the corresponding sub-fields of the image.

13. The method of claim 10, wherein first group maintenance discharge lengths and second group maintenance discharge lengths are in an identical order in the plurality of sub-fields.

14. The method of claim 13, wherein first group maintenance discharge lengths and second group maintenance discharge lengths are in an increasing order of a prescribed ratio of the maintenance discharge lengths.

15. The method of claim 10, wherein at least one sub-field of the sub-frame includes a maintenance discharge period to an image of a group, an addressing period to the image of the group and a first suspension period to the image of the group.

16. The method of claim 15, wherein the first suspension period one of precedes and succeeds the addressing period to the image of the group.

17. The method of claim 15, wherein the at least one sub-field further comprises a second suspension period, and wherein one of the addressing period and the maintenance discharge period is between the first and second suspension periods.

18. A method of driving a display panel device having a plurality of pixel cells arranged in a matrix form of rows and columns to display an image, each of the cells having first electrodes extending in a first direction coupled with one another; second electrodes parallel to the first electrodes and addressing electrodes that are orthogonal to the first and second electrodes, the method comprising:

writing an image of a first group of the second electrodes to the display panel device in an addressing period for maintenance discharge to the image of the first group of the second electrodes, and concurrently performing the maintenance discharge on an image of a second group of the second electrodes in the addressing period; and performing the maintenance discharge on the image of the first group of the second electrodes, and concurrently writing the image of the second group of the second electrodes to the plasma display panel device in the addressing period for the next succeeding maintenance discharge to the image of the second group of the second electrodes, wherein the first and second groups each form a sub-frame of the image, wherein the writing step and the performing step form a sub-field of the sub-frames, wherein a plurality of intensity levels are provided using prescribed maintenance discharge lengths in the sub-fields, and wherein first group maintenance discharge lengths and second group maintenance discharge lengths are in an identical order in the plurality of sub-fields in each of the sub-frames, and wherein each image forming period to each of said electrode groups preceded by a single period in which the electrodes are prepared for the image forming by at least one of writing and erasing all members of said each group at the same time.

* * * * *